United States Patent [19]

Monreal

[11] Patent Number: 4,676,521

[45] Date of Patent: Jun. 30, 1987

[54] KNEELING SKIS WITH HANDLES

[76] Inventor: F. Javier Monreal, 4242 Barker Hill Rd., Jamesville, N.Y. 13078

[21] Appl. No.: 861,913

[22] Filed: May 12, 1986

Related U.S. Application Data

[63] Continuation-in-part of Ser. No. 719,525, Apr. 3, 1985, Pat. No. 4,598,927, Ser. No. 721,686, Apr. 10, 1985, Pat. No. 4,648,849, and Ser. No. 774,010, Sep. 9, 1985, Pat. No. 4,623,158.

[51] Int. Cl.[4] ..... A63C 5/00

[52] U.S. Cl. ..... 280/606; 280/607; 280/609; 280/611

[58] Field of Search ..... 280/11.12, 601, 606, 280/607, 609, 611, 809

[56] References Cited

U.S. PATENT DOCUMENTS

| | | | |
|---|---|---|---|
| 1,138,973 | 5/1915 | Prince | 2/24 |
| 1,264,767 | 4/1918 | Boynton et al. | 2/24 |
| 1,293,240 | 2/1919 | Summers | 2/24 |
| 1,486,308 | 3/1924 | Shook | 2/24 |
| 1,547,166 | 7/1925 | Davidson | 2/24 |
| 1,668,623 | 5/1928 | Avril | 280/87.02 R |
| 2,242,156 | 9/1940 | Wallace | 280/601 |
| 2,318,059 | 5/1943 | Cooper | 280/32.6 X |
| 2,448,427 | 8/1948 | Gordon | 280/32.5 |
| 2,480,406 | 8/1949 | Forney | 280/12.1 |
| 2,484,494 | 10/1949 | Ferguson | 2/24 |
| 3,025,526 | 3/1962 | Ramon | 2/24 |
| 3,112,812 | 12/1963 | Ramon | 2/24 X |
| 3,689,092 | 9/1972 | Lake | 280/809 X |
| 3,908,198 | 9/1975 | Brock | 2/24 |
| 3,945,047 | 3/1976 | Jarrell | 2/24 |
| 4,028,761 | 6/1977 | Taylor | 280/18 X |
| 4,333,181 | 6/1982 | Corriero | 2/24 |
| 4,353,573 | 10/1982 | Morgan | 280/12 R X |
| 4,413,832 | 11/1983 | Pendleton | 280/12 R |

FOREIGN PATENT DOCUMENTS

| | | | |
|---|---|---|---|
| 174845 | 5/1953 | Austria | 280/607 |
| 843232 | 7/1952 | Fed. Rep. of Germany | 2/24 |

*Primary Examiner*—John J. Love
*Assistant Examiner*—Michael Mar

[57] ABSTRACT

A sporting, skiing, paired device to support the skier in the kneeling position, device that provides a ski and an embracing support for the kneeling knee holding the lower part of the thigh and at least part of the upper calf, skiing device that allows the kneeling rider to lean forward by providing, at the front of the ski a handle that distributes forward the weight bearing area and increases the aerodynamics of the rider. Different forms of handles are described, along with built-in-one block, or detachable-from-the-ski embracing knee supports.

2 Claims, 7 Drawing Figures

KNEELING SKIS WITH HANDLES

BACKGROUND AND PURPOSE

This patent application is a continuation-in-part of earlier patent applications #06/719,525 filed 4/03/85, now U.S. Pat. No. 4,598,927, #06/721,686 filed 4/10/85, now U.S. Pat. No. 4,648,849 and #06/774,010 filed 9/09/85, now U.S. Pat. No. 4,623,158 that have already been allowed.

Besides the paired sporting kneeling devices described in those patent applications, related non-paired kneeling devices of this inventor also include:

A "Kneeling or sitting sled" (#06/751,599) now U.S. Pat. No. 4,603,870;

A "Water gliding board" (#06/672,813) now U.S. Pat. No. 4,629,434;

A "Water and snow wishbone shaped sled for one or two" (#06/806,423) pending;

A "Mushroom shaped water glider" (#06/822,627) pending;

And a "Water gliding scooter board" (#06/832,389) pending.

Related kneeling prior art work of others include:

R. C. Avril's "Coaster" of 5/8/1928 U.S. Pat. No. 1,668,623

W. A. Boynton & G. A. Terrell's "Cotton Picker's Knee Pad" of 4/30/1918 U.S. Pat. No. 1,264,767

W. L. Brock's "Seam Skate for Carpets" of 9/30/75, U.S. Pat. No. 3,908,198.

F. T. Cooper's "Kneeling Dolly" of 5/4/43, U.S. Pat. No. 2,318,059

J. Corriero's "Protective Structures for Joints" of 6/8/82, U.S. Pat. No. 4,333,181.

H. K. Davidson's "Knee Pad" of 7/28/25 U.S. Pat. No. 1,547,166.

A. Deppe's "Securing Knee Protector" of 7/7/52 East German Pat. No. 843,232

R. O. Ferguson's "Knee Pad" of 10/11/49, U.S. Pat. No. 2,484,494

J. C. Forney's "Knee Sled" of 8/30/49 U.S. Pat. No. 2,480,406

B. Gordon's "Knee Pad Dolly" of 8/31/48 U.S. Pat No. 2,448,427

R. P. Jarrell's "Knee Protector" of 3/23/76, U.S. Pat. No. 3,945,047

Klima's "Knee Ski" of May 11, 1953, Austrian Pat. No. 174,845

G. F. Lake's "Snow & Water Skimming Drvice" of 9/5/72 U.S. Pat. No. 3,689,092

D. F. Morgan's "Knee Engaging Ski" of 10/12/82, U.S. Pat. No. 4,353,573

J. E. Pendleton's "Body Sled" of 11/8/83, U.S. Pat. No. 4,413,832

P. Prince's "Knee Rest for Cotton Pickers" of 5/11/15, U.S. Pat. No. 1,138,973

G. Ramon's "Knee Rest" of 12/3/63, U.S. Pat. No. 3,112,812

G. Ramon's "Kneeling Devices" of 3/20/62 U.S. Pat. No. 3,025,526

P. J. Summers' "Knee Pad" 2/4/19, U.S. Pat. No. 1,293,240

T. H. Shook's "Knee Pad" of 3/11/24, U.S. Pat. No. 1,486,308

J. Taylor's "Multipuorpose Slide" of 6/14/77, U.S. Pat. No. 4,028,761

J. M. Wallace's "Ski" of 9/19/40, U.S. Pat. No. 2,242,156

This present invention, though aimed primarily at skis intended to be used in the kneeling position, it does not relate to the form of securing the knee to the ski, matter that is esentially covered by this inventor's earlier applications of which this is a continuation-in-part. The basic mechanical arrangement, therefore, of a short Knee-Boot lockable into ordinary ski bindings, or of a longer Knee-Foot Boot, both holding with or without a pivoting part the lower one third to one half of the user's thigh, remains the same.

This invention relates to the ski members themselves (one per leg) as it introduces important mechanical changes that affect the ride and control of the ski substantially. Indeed, after testing extensively a number of prototypes of kneeling skis, it has been necessary to add handles to the front and of each ski to allow the rider to lean forward as aerodynamically as possible while providing, by resting on one's hands, additional base of support and stability, and extra torque and control of the ride in making turns, not only by tilting the ski sideways, but also by lifting and bending the semi-flexible front end of the ski.

BRIEF DESCRIPTION OF THE INVENTION

This sporting device to slide on slippery surfaces, primarily on snow, consists of paired ski members, one for each leg, intended to support the skier in the kneeling position, thus containing, in the weight-bearing area, a shell or knee-boot to firmly hold the skier's knee and lower thigh, knee-boot permanently attached to the ski, or lockable/unlockable by standard ski bindings and extending or not to the foot area, as described in this inventor's prior patent applications, already allowed and of which this invention is a continuation-in-part. The new material purpose of this invention is the handle with which each ski is provided in its front end so the skier, while kneeling, can rest his/her hands forward on each ski thus allowing some steering and extra torque not just by tilting to one side, but actually by pulling and bending the front end of the ski. Various shapes and sizes of handles are described, some bolted to the ski some being part of each ski member itself as a curved-up continuation of its front tip, or as a built-in upward curved of the front third of the ski. A ski "braking" mechanism is also described.

DETAILED DESCRIPTION OF THE INVENTION

This paired recreational/sporting device is intended to slide on snow or ice with the rider kneeling deep down, trunk bent fowards and hands holding a pair of handles, the description of which is the main subject matter of this invention.

Figure 1:
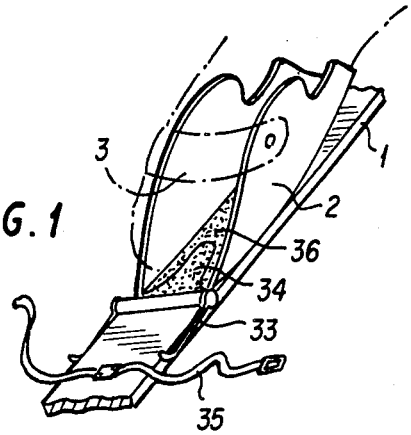
FIG. 1: Is a left lateral perspective view of the front part of the knee-boot with the ski ends cutoff (partial cut off of FIG. 2).

Each ski, as shown in all the figures and identified by the numeral 1 has a weight bearing area that accomodates and holds the user's kneeling knee and lower one third of the thigh and has already been described in prior patent applications named above. This area that holds the knee of the user and is described as a Long Knee Foot Boot (numeral 2 of FIGS. 1, 2 and 6) may hold the user's whole lower leg from knee through foot, and the lower part of the thigh in a non-articulated fashion, having an elastic strap 3 to hold the front of the user's thigh; this Long Knee-Foot Boot may also have the thigh holding area as a pair of interconnected medial and lateral wings (FIGS. 3 and 4, numeral 4) that are pivoted upon the front end of the Long Knee Foot Boot to allow various degrees of flexion and extension of the knee. In this arrangement of a pivoted thigh hold, the pivoted part with the medial and lateral wings 4 and 4 is kept in a rearward flexion via a pair of elastic straps 5 and 5. An optional fastenable and adjustable strap 6 may be used to hold the user's lower part of the calf to the Long Knee-Foot Boot, though it is not necessary to keep the leg in place and it does not add extra control of the ski. This optional strap 6 is only used in situations where the user purposely does not want the ski to release in a tumble, for instance where a very short ski is used, ski that can remain attached to the leg and tumbles in a fall with the skier.

Figure 5:
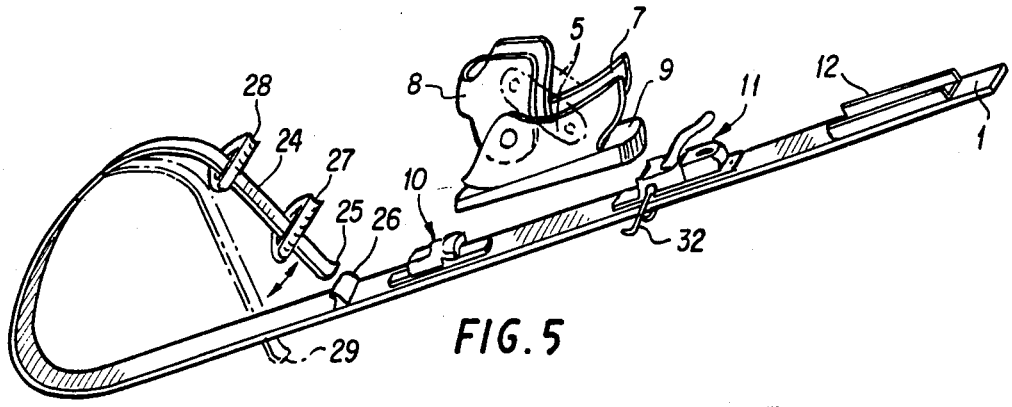
FIG. 5: It depicts a ski with well upcurved handle that has a movable free end so when it is pushed forward it sinks down in the snow and acts as a brake. The knee hold is by means of a short knee-boot lockable into ordinary bindings.

This inventor has also described a short form of Sporting Knee Boot depicted (detached from the binding) in FIG. 5 and identified by the numeral 7. This short Knee Boot also holds (as the long one) the user's knee, upper part of the sides of the lower leg, and with a similar pivoted thigh section, the lower half to one third of the sides of the thigh, being this thigh section an approximate letter H shape where the two side arms are the medial and lateral wings of said thigh section and where the horizontal bar is the interconnecting piece that bridges the two wings over the front of the user's thigh. The pivoted thigh hold is identified in FIG. 5 by the numeral 8. The weight bearing area of this short knee boot is shaped and thickened and sized as the user's ordinary ski boot sole so as to fit and lock into the same standard ski binding. This sole is identified in FIG. 5 by the numeral 9, being the standard ski bindings identified as 10 for the toe hold and 11 for the heel hold. In this type of arrangement with a detachable short Knee Boot, the person can use the ski to stand on it if he/she wishes and specially to take the chair lifts while keeping the skis on one's feet, or to kneel, once at the top of the slope. When kneeling on the ski with this type of arrangement, the user's knee rests on the knee boot that is locked into the bindings, the tip of his/her shoe rests on the U shaped bracket 12, and his/her hands hold the front handles described further down (if he/she are leaning forward instead of leaning back and using short ski poles).

Figure 2:
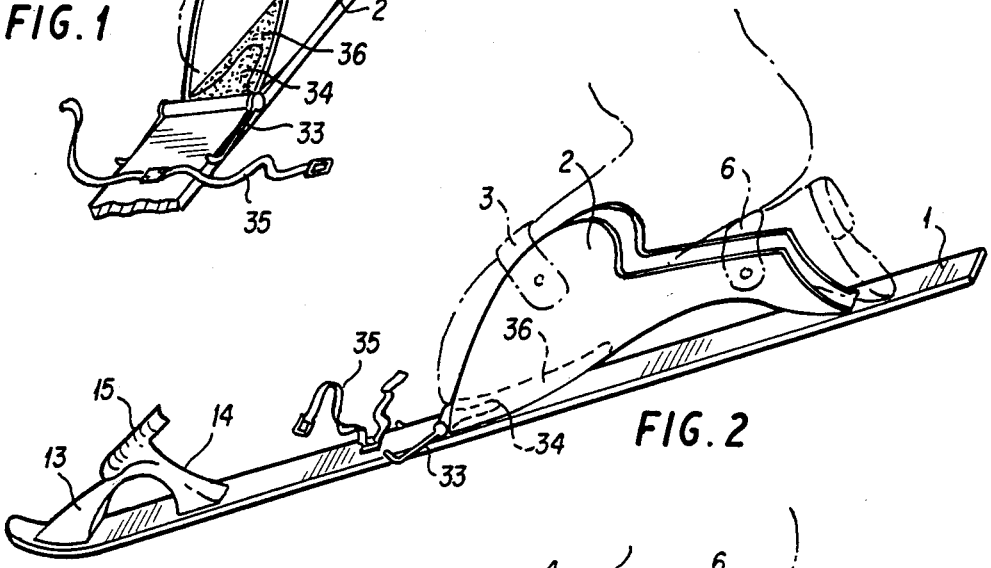
FIG. 2: Is a full view of the ski with long knee-foot boot and with handle in the front. The thigh hold of the boot does not pivot.

When the skier kneels on a pair of skis provided with the described suitable knee-lower leg-foot-thigh hold, he/she have the choice of either leaning backward with the trunk semi-erect with the weight of the buttocks upon one's heels, or of leaning all the way forward and holding on to the front end of the skis by the provided handles that are now described:

The handle 13 depicted in FIG. 2, is bolted to the forward-most up-swept area of the ski and parallel to the main length of the ski, so the skier can grab this handle by its reard half marked by the numeral 14. An optional transverse semi concave bar 15 is placed at the top of the handle (and made all of one single cast metal or plastic piece with the main handle), so the skier may grab the handle at point 14 or, transversely, at section 15. The transverse bar 15 is purposely made mildly concave in its length so the skier (who may be carrying ski poles in his hands if he was initially leaning backwards and maneuvering through a slalom course with poles) may grab such bar 15 while the ski pole handle, still in his hand, fits into the concavity of such bar 15, thus being able to hold on to both things at the same time.

Figure 3:
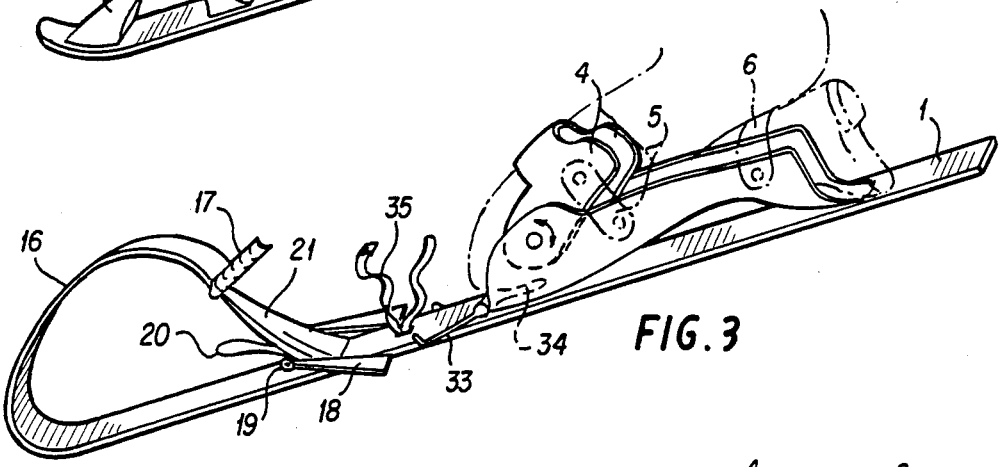
FIG. 3: Is a full view of the ski as in FIG. 2 with a larger handle that is an extension of the front tip of the ski, handle that has a hand brake depicted. The thigh hold of the boot is articulated and pivotable.

The handle 16 depicted in FIG. 3 is larger than handle 13 just described. Handle 16 is built as an upward-and-then-rear and downward swept extension of the front end of the ski. It also may be provided with a transverse and semiconcave transverse bar 17 to accomodate the handle of the ski pole if the skier was holding on to them and then leans forward to grab the handle 16. This FIG. 3 also depicts a controllable brake 18. A pair of brake paddles 18, one on each side of each ski, pivot downward, to dig in the snow, upon an axis 19 when the ski pulls up the lever 20. The skier can thus slow down by pulling up such lever if he/she is just holding the longitudinal section of the handle at point 21. If he/she is holding also the ski pole and resting it on the transverse bar 17, then there is no need of using the brake 18 to slow down; instead, one simply tilts the ski pole so its out-extending tip digs in the snow while its handle is still kept on the groove or concavity of the transverse bar 17 that one tilts sideways upon the main handle 16 of the ski. Both paddles 18 of the brake are kept up off the snow (except for braking), by a spring action built into their pivoting axis 19.

Figure 4:
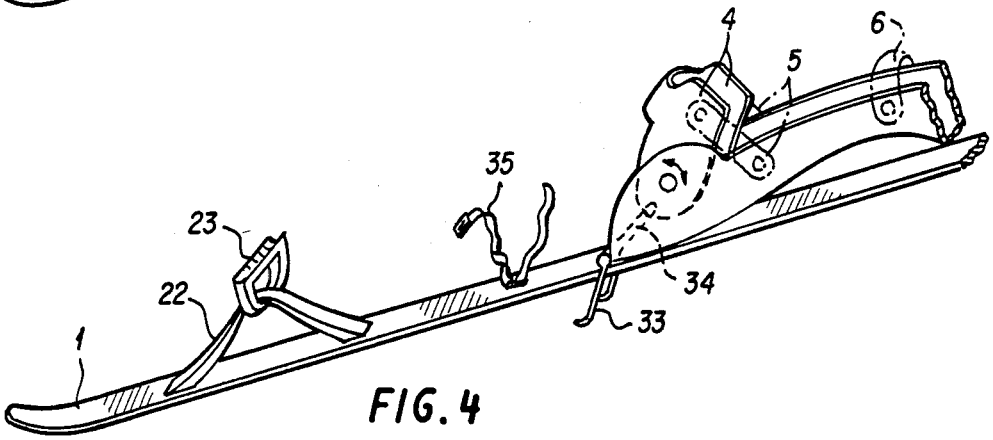
FIG. 4: It shows esentially the same instant invention as depicted in FIG. 2, but with a longer front end of the ski so the handle is somewhat further back.

The handle 22 of FIG. 4 is similar to that of FIG. 2 but here it is depicted further back and away from the tip of the ski. In this type of arrangement, the front section of the ski (from the kneeling area to the front tip of the ski) is much longer than in FIGS. 2 and 4 so with the semi-flexible charcter of the ski, its whole front can be bent and thus maneuvered better, specially in deep snow. This handle 22 also has built-in as a single block a transverse handle with a groove at its top 23. If the skier has ski poles in his/her hands, but now decides to lean forward to hold the handles, instead of grabbing the handle 22, grabs its transverse bar 23 with the ski pole fitting into its groove.

FIG. 5 shows another larger type of handle possible 24, handle that as the handle of FIG. 3, is a prolongation of the tip of the ski, but here, the upsweep of the handle is more marked and its distal rear tip is floating or unfastened to the ski. Its said distal floating tip 25 has a small L shape protruding end that in an ordinary downhill descent hooks to a matching "female" bracket 26 keeping thus firmly in place. In case the skier needs to brake and slow down, he/she pushes down and slightly out so the tip 25 becomes disengaged from its holding bracket 26 and the whole free end of the handle 24 digs in the snow on the side of the ski. For this braking action, the skier preferably holds the transverse bar 27, but for the normal descent, better torque and control is gained by grabbing the handle at the higher placed transverse bar 28. The braking position of the handle 24 is indicated in a dashed outline identified by the numeral 29.

Figure 6:
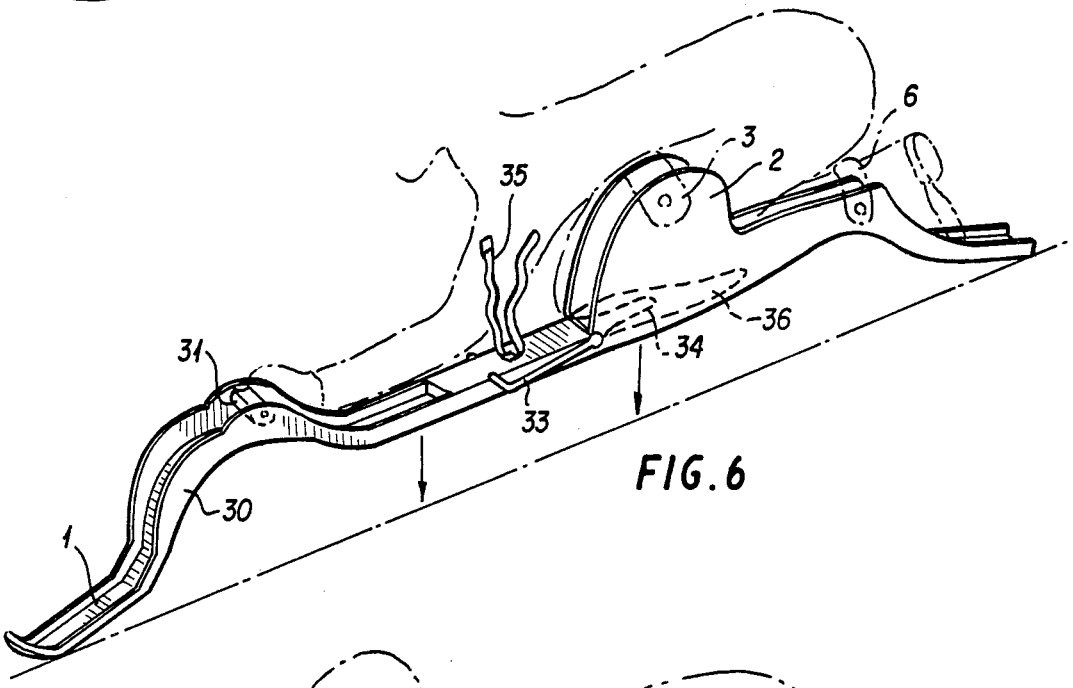
FIG. 6: It shows a modified ski so its front handle is part of its general outline, and so is the built-in long knee-foot boot, for easier, one single piece and one step vacuum-molded construction. The pronounced "bowing" of the ski is purposely so. The rider is depicted in dashed lines.

FIG. 6 depicts a type of handle 30 that is esentially as the handles of FIGS. 3 and 4, but here the handle is not a continuation of the ski or bolted to it, but part of the ski profile itself, so in the area of handle 30, the ski bottom is not in contact with the snow. This same arrangement is made in the area of the long Knee Foot Boot, the construction of which is part of the ski, specially in vacuum-molded construction, so in such area the ski bottom is not in contact with the snow either. This type of device with "empty gaps" in the course of the ski, the inventor has already tested and it works fine for downhill descent in packed snow; however, when making turns (by tilting one's weight and pulling the handle up and to a side), the weight bearing area immediately under one's knees tends to act as a pivot in the snow with the unwanted result that instead of one making a smooth turn, one ends up making a completer U-turn. Thus to avoid this pivoting of the weight bearing "kneeling" area that tends to sink in the snow, FIG. 6 depicts the bottom outline of the whole ski with a marked up-swept bowing or arching that only flattens itself by kneeling and bearing weight on the ski. This FIG. 6 with the ski, its handle and its leg holding area in one piece, has, in cross section, a U-shape with up-swept side edges through its entire length to strengthen it while avoiding excessive thickness and weight and thus waste of material. While an aluminum and fiberglass combination could allow a fairly thin and flat ski without the U-section type of reinforcement, in a toy version for children where a low construction price is important, such U-section reinforcement may be both cheap and practical in a one piece plastic ski.

Figure 7:
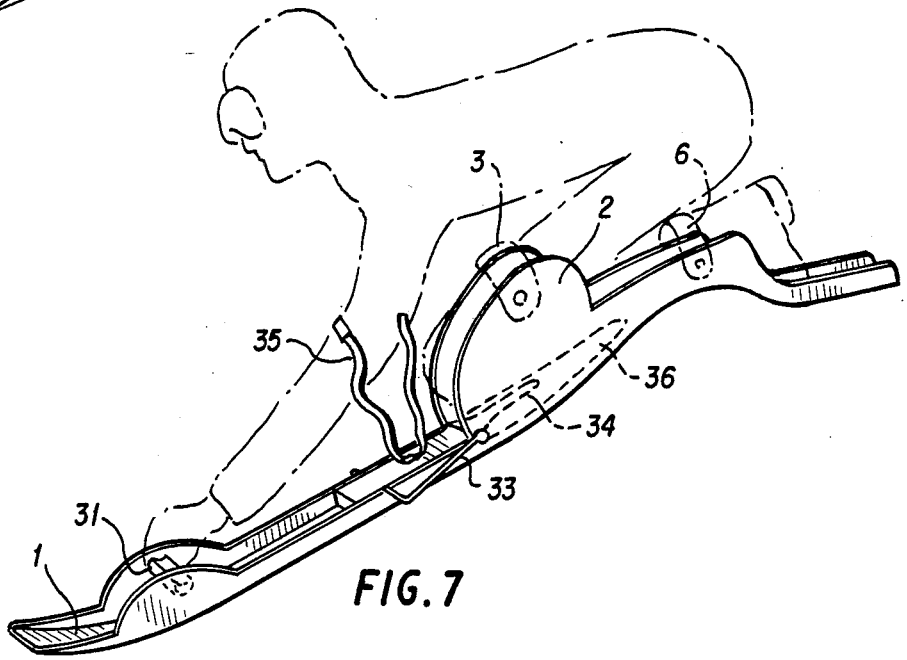
FIG. 7: It shows a partial left lateral, perspective view of the ski (only its front end is shown) with a very simple type of transverse handle placed between a built-up medial and lateral lip of the ski.

FIG. 7 shows only a front section of that type of plastic ski with a U-cross section. A very simple cross bar 31 acts as a handle.

The last two types of ski construction with their respective handles, as in FIGS. 6 and 7, may also be provided with controllable brakes to slow down (are not depicted in those two figures) but such accesory is optional in skis intended for backyard use as a toy.

Besides the controllable brakes placed at the front handles, current safety regulations in some ski resorts require that after a tumble, and once the ski bindings release, that the skis have some sort of automatic braking mechanism so they do not continue to slide too far down by themselves. The kneeling skis with handles described here, therefore have such a provision, which is esentially opposite to the controllable brakes that are placed in the front handles: In the ski of FIG. 5 the short Knee Boot locks into ordinary bindings the heel piece of which 11 has a pair of prongs that automatically spring down (number 32) when the Knee Boot or the regular foot boot is released. FIGS. 1, 2, 3, 4 and 6 offer an esentially similar type of mechanism with the pair of prongs 33 kept up and off the snow when the pivoting lever 34 is kept down by the weight of the knee. The axis of the combination prongs/lever has a built-in spring so when there is no weight applied on the lever it lifts up and the prongs sink down as shown in FIG. 4.

It is also important to be able to "stand" on the skis to take the chair lift up the slope. To make this possible, the strap 35 ties around the foot of the standing skier while he/she place the heel of the foot over the lever 34 to keep the prongs 33 in the "up" position. The padding that normally goes under the kneeling knee and over the lever 34 (padding shown in dotted line marked by the numeral 36 in FIGS. 2 and 6) is only attached at its rear so it can be lifted up and out of the way when the skier puts his/her heel on the lever 34 to stand on the ski.

I claim:

1. A pair of skiing devices capable of supporting a skier while in a kneeling position, each one of the pair of skiing devices comprising:

a long and narow lightweight, tough and shapekeeping tension ski 3′ to 6′ long and 3″ to 4″ wide, a plastic sheeting material, with a rounded upwardly extending front tip, a square cut-off rear end and horizontal longitudinal profile slightly bowed upwardly from front to rear so when placed skier-less on the ground its mid sectionn is 2″ to 3″ off the ground, said ski in cross-section having a U-shaped profile, the bottom of said U forming a pair of up-turned side lips extending upwardly from said contact surface of said ski a distance of 1″ to 3″ along the length of the ski, said lips of said ski having a first upward extension having a smoothly rounded shape for a longitudinal distance of 3″ to 4″ adjacent the forward portion of the ski, said side lips of said ski having a second upward extension with a smooth and rounded shape located approximately at the mid-section of said ski, said second extension of said side lips extending upwardly from said contact surface of said ski a distance of 6 to 8 inches and being capable of embracing the sides of the skier's kneeling knee and lower one third of the thigh, said second extension of said side lips continuing rearward with an upward span of 3″ to 4″ for embracing the sides of the skier's calf and ankle, said second extension then tapering down towards the rear of said ski as it becomes a continuum of said side lips, said ski having a slightly bowed-up longitudinal profile in the form of a ground-clearing gap with a smooth and upswept profile extending from a location adjacent the front portion of the ski to a maximum gap located adjacent the ankle supporting portion of the ski and downwardly to a location adjacent the rear of the ski, three straps located along the longitudinal length of the ski, the first strap being attached to said ski just in front of said second upward extension of said side lips and being capable of securing the skier's foot while standing, the second strap being attached to said ski at the highest point of the second upward extension and extending between the side lips for bridging over the skier's kneeling thigh, the third strap extending between the side lips at a location aft of said second strap for bridging over the skier's ankle while in a kneeling position;

a hand support means consisting of a transverse rod firmly secured between the said lips of said first upward extension, an automatic ski braking means located at the most forward point of said second upward extension of said side lips and comprising a pair of side pronge capable of assuming a downward position when braking and a horizontal position when retracted, an axle connecting said prongs, lever means for maintaining said side prongs in a retracted position when said lever means is engaged by either the knee or the heel of the skier while in a skiing position, and spring means for biasing said prongs to a braking position when said lever means is not engaged by the skier;

a soft pad located on the ski between the side lips of said second extension for cushioning the skier's kneeling knee and shin; and support means consisting of a rectangular, flat, lightweight material fitted between said side lips in front of said second upward extension and under said first strap for supporting the sole of a standing skier's foot.

2. A skiing device according to claim 1 wherein said transverse rod has a concave upper surface capable of accomodating the round configuration of the handgrip of a standard ski pole for permitting the skier to hold the transverse rod and the ski pole simultaneously.

* * * * *